United States Patent [19]

Miller et al.

[11] 4,062,913

[45] Dec. 13, 1977

[54] METHOD OF REINFORCING CONCRETE WITH FIBRES

[75] Inventors: Arvo Ivar Miller, Danderyd; Fritz Rune Björklund, Stockholm, both of Sweden

[73] Assignee: AB Institutet for Innovationsteknik, Stockholm, Sweden

[21] Appl. No.: 596,848

[22] Filed: July 17, 1975

[51] Int. Cl.[2] ..... B28B 23/02

[52] U.S. Cl. ..... 264/24; 52/659; 106/99; 264/71; 264/108; 425/3

[58] Field of Search ..... 264/71, 24, 108; 52/659; 425/3, DIG. 33; 106/99

[56] References Cited

U.S. PATENT DOCUMENTS

| | | | |
|---|---|---|---|
| 2,584,441 | 2/1952 | Fredendall | 264/108 X |
| 2,849,312 | 8/1958 | Peterman | 264/108 X |
| 3,073,732 | 1/1963 | Hunsdiecker | 264/108 X |
| 3,128,544 | 4/1964 | Allingham | 52/615 X |
| 3,312,763 | 4/1967 | Peccerill | 264/108 |
| 3,429,094 | 2/1969 | Romualdi | 52/659 X |
| 3,806,571 | 4/1974 | Ronnmark | 264/135 X |

*Primary Examiner*—Thomas P. Pavelko
*Attorney, Agent, or Firm*—Finnegan, Henderson, Farabow & Garrett

[57] ABSTRACT

The invention relates to the reinforcement of material with fibres, whereby the fibres are orientated by means of electrical fields. In this way, the fibres can also be concentrated on places which are especially subjected to stress so that a considerably greater strength increase is obtained from a smaller amount of reinforcement fibres than used in conventional methods.

6 Claims, 3 Drawing Figures

METHOD OF REINFORCING CONCRETE WITH FIBRES

Figure 1:
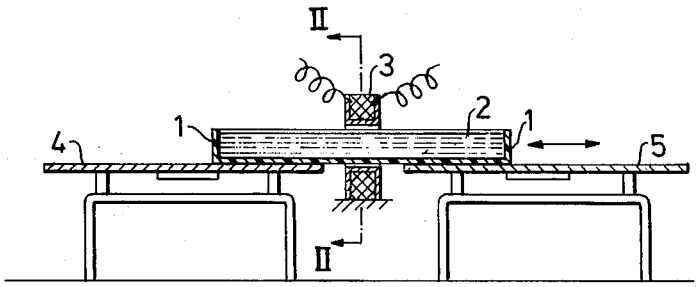

The construction industry has been completely revolutionized since modern concrete was put into general use at the turn of the century. Concrete is manufactured by means of mixing cement with sand, shingle and water into a smooth composition which is cast and allowed to harden into silicate hydrates. Concrete can absorb great pressure loads but cannot be subjected to any larger tensile stresses without cracking. In order to improve the properties of concrete, rods of steel or iron have been cast into the same and, more recently, various types of prestressing of the reinforcement iron have been developed in order to provide the entire construction with a certain tension. The improvement of concrete by means of the addition of various fibres is not a new idea either, and asbestos fibres have been used for quite some time in order to improve the properties of various cement paste products, for example roof tiles and facade panels.

However, the asbestos fibres do not provide the concrete with enough strength to be suitable for construction purposes and, thus, other fibres, primarily fibres of glass, steel and plastic (polypropene) have been used with good results.

The good properties of glass fibres have been used very advantageously in connection with reinforcement of plastic. However, the problems inherent in the reinforcement of concrete are not the same as the ones inherent in the reinforcement of plastic due to a different relationship between the modulus of elasticity of the components. In plastic, the reinforcement fibres absorb the larger portion of the applied tensile load and prevent formation of cracks and fractures, while in concrete the fibres function in such a way that they prevent the spreading of microcracks which are always present in concrete.

The type of fibre which appears to be most natural and suitable in concrete is steel fibre. This can be seen in relation to the previous use of iron for reinforcement, the inexpensive price of steel fibres, their relatively great strength and resistance to corrosion in an alkaline environment.

Many investigations have been made, both in the United States and in Sweden, concerning the mixture of steel fibres into concrete. One problem has been the actual mixing of the steel fibre into the concrete. If too many fibres are mixed into the concrete, they agglomerate into lumps or balls. The limit appears to lie within 1–3% if a simple mixing technique is used and the fibres are simply sprinkled into the concrete during mixing. However, the agglomeration of the fibres is reduced by means of using a cement-rich mixture and a maximum pebble size of 10–12 mm. Further, it has been found that a suitable value for the ratio between the length and size of the fibres should be approximately 100.

The improved strength values and the high fatigue limit make steel fibre-reinforced concrete suitable for pavements, cast coatings and concrete slabs, for example. Furthermore, it is suitable for the factory manufacture of concrete panelling and shell constructions.

The material properties of concrete are, inter alia, characterized in that its tensile strength is, as a rule, only 10% of the compressive strength. The greatest tensile forces in reinforced concrete structures arise, as a rule, by means of bending and, in a beam subjected to bending, pressure is applied to one edge and pull in the other.

A reinforced concrete structure shall function statically. However, it shall also function aesthetically so that it meets with the wishes or the orderer. If the steel, i.e. the reinforcement, in the concret corrodes, the strength of the structure is affected. Further, corrosion also gives rise to ugly fractures or cracks and discolourations.

In theory, a thin covering layer of compact concrete should be sufficient to prevent corrosion. However, no concrete is totally compact. In order to counteract possible leakage, the thickness of the covering layer can be increased but if it becomes too thick it will easily crack since the ability of the steel to hold together the concrete is reduced when the thickness of the covering layer is increased. Actually, the thickness of the covering layer becomes dependent on the adhesion and anchorage of the reinforcement fibres in the concrete.

In common fibre concrete, the fibres are randomly distributed. This entails that some of the fibres will lie near to or on the surface and be subjected to corrosion. Further, in slabs it is desirable to obtain a parallel planar orientation of the fibres and a certain concentration of the fibres near that edge of the structure which is subjected to tension.

In order to achieve an efficient fibre reinforcement, the fibres should be aligned in the direction of stress. However, the normal mixing procedures for steel fibre reinforced concrete tend to produce a three-dimensional random orientation of fibres.

The reinforcement effect of fibre orientation is demonstrated by the following table.

| Orientation | Effectiveness |
|---|---|
| Unidirectional | 100% |
| Orthogonal plane | 40–50% |
| 2 dim. array random plane | 30–38% |
| 3 dim. array random solid | 0–20% |

One finds, for example, that the reinforcement effect for a certain fibre volume becomes more than five times as great in the fibre direction than in any other direction and that two-dimensional orientation in a plane is almost twice as effective as three-dimensional orientation. It is also possible to incorporate more fibres in flat, sheet-like material than in three-dimensional material.

When one knows that the material is subjected to stresses in a special direction, it is most economical to direct the fibres in the same direction. In relatively thin sections it is desirable to obtain a certain concentration of fibres at especially affected places, for example near edges which are subjected to tension.

According to the invention the desired fibre direction is obtained by means of magnetic fields. Under the influence of the magnetic field, ferromagnetic fibres attempt to orient themselves along the lines of force of the field. The fibres can also be subjected to magnetic vibration which affects the viscosity of the concrete and expediates the orientation and movement of the fibres in the concrete mass.

A suitable pulse device for electromagnets for vibration and orientation of ferromagnetic fibres essentially comprises a pulsed full-wave rectifier in which the length of the pulses can be varied and the time lapse between pulses can also be varied. Naturally, the fibres can be caused to vibrate by means of feeding a magnetic coil with AC current.

According to the invention the magnetic field is allowed to change poles at a suitable frequency, the size of which is dependent on the mass and length of the fibres. In this manner a vibration of the fibres is obtained, said vibration affecting the viscosity of the concrete and expediating the orientation and movement of the fibres in the concrete mass. Several magnetic fields can also be combined in order to provide a deep effect in order to orient the fibres in complicated structures.

The magnetic field needed for the orientation or movement of the fibres can, in principle, be made up of electromagnets or permanent magnets. A more detailed description of the simplest case of electromagnetic fibre orientation is provided below.

If wire is wound up into the form of a coil, one finds that the lines of force cooperate with each other along the sides of the coil. The result will be a group of lines of force which enter and leave through the ends of the coil and extend through the surrounding air, in other words the line of force pattern becomes the same as for a rod-shaped permanent magnet. The strength of the magnetic field will be proportional to the current in the coil and the coil density of the same. In practice, one often uses ampere turn per length unit to express the field strength.

Coils of various sizes can be used for the orientation of fibres in concrete slabs, panels, beams, pipes etc. In order to obtain both powerful and rapid effect, coils within the size range of 1000 ampere turns should be used.

The advantages of the vibration are fully made use of only if consistency and water content are adapted to methods and possibilities.

The effect of a vibrator in the concrete depends on both the frequencies and the size of the amplitudes. The vibration movement's acceleration, which is a function of (frequency)$^2$ $\times$ (amplitude), is often disclosed as a measure of vibration intensities.

The best results have been obtained by means of a combination of conventional and electric vibration. The used fibre content in fibre concrete is relatively small, generally only 1–3% by volume and, thus, is not able to set the entire concrete mass into motion when normal consistencies are used. The effect of the conventional vibration is determined by the frequency or amplitude of the vibration or by the acceleration of the vibration movement — (frequency)$^2$ $\times$ (amplitude). In a certain concrete consistency, a certain minimum acceleration of the vibrator must be achieved in order that the concrete shall be converted and obtain fully satisfactory strength. The minimum acceleration is dependent on the consistency of the concrete and the dimensions of the mould. A damp concrete calls for about 5 g, while an elastic to hard concrete is converted at an acceleration of 1 to 2 g.

It is desirable that both the frequency and the amplitude can, in an ideal vibrator, be varied depending on the consistency of the concrete and the dimensions of the mould. In table vibration, fully satisfactory and generally equitable vibration results can be achieved with frequencies of 3000–9000 vibrations per minute, for example, and amplitudes greater than 0.05 mm chosen from a relatively large range. In some cases, the optional frequency has even shown itself to lie within the vicinity of 18000.

A magnetic field of varying amplitude (field strength) and frequency can be made up of a number of electromagnets. The magnetic field can also be passed over the mould in which the fibre concrete has been cast, said mould being able to be placed on a conventional vibrating table. The vibrating table and the magnet can alternatively be built together into the same unit.

Fibre orientation can be influenced by means of rotating the magnets and by means of unsymmetrical amplitude.

The fibres can be mixed into the concrete mass or added to the top surface of the concrete immediately after casting. The fibres can alternatively be placed in the moulding block prior to the casting of the concrete.

Thus the fibres can be worked into the concrete, be moved about therein and orientated with the help of magnetic fields and vibration. Of special interest is the fact that the fibres can be moved from the surface and down into the concrete and thereby be prevented from discolouring the concrete surface by means of corrosion.

It has also been found possible to combine the fibres with small, short steel rods or also with common reinforcement (reinforcment iron or mesh) and therewith obtain interaction between the good properties of the fibres and the other reinforcement.

Figure 2:
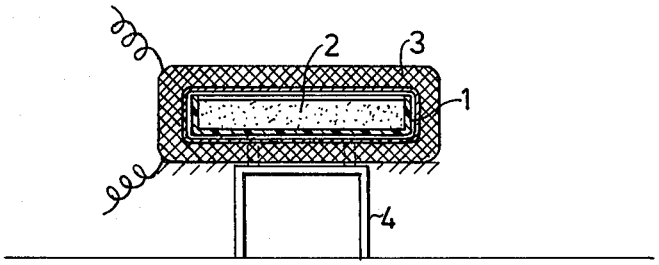
Figure 3:
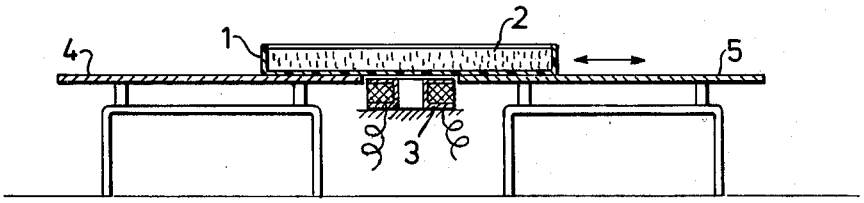

Fibre orientation according to the invention is described below in more detail in the form of an embodiment and in connection with the accompanying drawings, in which FIG. 1 shows a cross section of a device for the orientation of fibres in concrete, FIG. 2 shows a section of the device according to FIG. 1 drawn along the line II—II, and FIG. 3 shows a cross section of a horizontal arrangement of the magnetic coil.

Fibre orientation is carried out by means of a mould 1 of non-magnetic material, for example plywood or plastics, being filled with fibre concrete 2 and transported through a magnetic coil 3, whereby the mould is vibrated. The device is suitably combined so that a table vibrator 4 and 5 is arranged on both sides of the magnetic coil 3 and mould 1 with the fibre concrete 2 is passed back and forth through the coil several times, preferably 4–8 times.

If the anchoring of the fibres in places which are especially subjected to wear and tear is desired, the transport speed through the coil is reduced when said places pass through the coil.

The addition of fibres to the mixed concrete which, preferably, has been cast in a slab-shaped mould can be carried out in the following manner. The magnetic coil 3 which has been described above and which, for example, is situated between two table vibrators, is turned horizontally so that the coil axis and the magnetic lines extend vertically as shown in FIG. 3. The fibres are placed on top of the concrete and, when current is passed through the magnetic coil 3 and the mould 1 is vibrated, the fibres are drawn more or less vertically into the concrete 2. By means of rotating the magnet in relation to the horizontal plane, the fibres will be drawn into the concrete at an oblique angle. The fibres are thereafter orientated according to the previous description, whereby the mould is passed through a vertical magnetic coil according to FIG. 1.

If desired final compression is, after magnetic orientation, effected by means of vibration alone.

In principle, a magnetic coil can be wound in optional dimensions and, thus, the dimensions of the concrete product are also optional. Magnetic orientation has, to date, been successfully tested on up to 40 mm thick sample bodies.

EXAMPLE

| | |
|---|---|
| Composition of the mix: | |
| Water - cement - sand | 0.5 : 1.0 : 2.3 |
| Aggregate grading | 0–2 mm |
| Fibre content | 1.5% by volume |
| Coil: | |
| Number of turns | 1000 |
| Current intensity | 8 ampere |
| Vibration during fibre orientation: | |
| Frequency | 3000 vibrations/min. |
| Amplitude | 0.5 mm |
| Vibrations during final compression: | |
| Frequency | 4500 vibrations/min. |
| Amplitude | 0.2 mm |

The time for the magnetic orientation was 15 seconds and the 36 cm long sample body was passed back and forth through the coil 6 times.

Tests have been made with different fibre dimensions and sample thicknesses both with and without orientation of the fibres and the values of the flexural strength and impact strength have been measured. The values are compiled in the following table.

| Fibre type Length/ diameter | Thickness of the sample | Flexural strength $MN/m^2$ | | Impact strength $KG/m^2$ | |
|---|---|---|---|---|---|
| | | Unaligned | Aligned | Unaligned | Aligned |
| 25/0.38 mm | 10 mm | 9.1 | 25.7 | 11 | 19 |
| " | 20 mm | 7.5 | 21.0 | 16 | 31 |
| 25/0.25 mm | 10 mm | 10.2 | 21.6 | 16 | 30 |

In certain cases, the reinforcement fibres can be subjected to corrosion either by means of the surrounding material or by means of various corrosive substances from the surroundng environment being diffused through the reinforced material. Examples of this are steel fibres in thin concrete structures in which water can diffuse through the pores or microcracks of the concrete. Naturally, in such cases it is possible to use corrosion-resistant fibres, for example fibres of stainless steel. However, this is an expensive solution.

It is also possible, however, to provide the fibres with a corrosion-resistant coating, for example by means of coating common steel fibres with some sort of resistant plastic material or cauterizing the fibres or coating them with a thin metal layer, for example as in common galvanic coating.

A simple way of achieving said protection which suffices for normal stresses is to spray the fibres with or immerse them in a solution, emulsion or plastic melt which, if desired, can be provided with a corrosion inhibitor. By means of using a plastic which is moistened with the material which is to be reinforced, no impairment of the strength values of the completed structures is obtained.

Other materials, for example plastics, can be reinforced with ferromagnetic fibres in the same manner as is the case with concrete. Thus, by means of reinforcing polyester plastics with steel fibres and orientating them with magnetic fields, a considerably greater strength than in common fibreglass-reinforced structures in which the fibres are arranged more or less at random can be obtained. Furthermore, a manufacturing method which is considerably quicker than the common reinforcement with glass fibres is obtained in this manner and a considerably smaller amount of fibres is need in order to obtain the same or greater strength in the structures. For example, the manufacture of plastic automobile chassis can become competitive in relation to present sheet metal structures if the method according to the present invention is used.

By means of using electrostatic fields, fibres other than ferromagnetic fibres, for example carbon fibres which have very great strength, can be orientated. Preliminary tests with boron fibres and fibres of other semiconductive material have provided promising results.

What we claim is:

1. A method for reinforcing concrete comprising:
introducing steel fibers randomly into a mass of unset concrete, and
orienting the steel fibers in a desired direction by subjecting the steel fibers to a magnetic field.

2. The method for reinforcing concrete according to claim 1 which comprises disposing steel fiber reinforcement in a cast mass of unset concrete and subjecting said mass to the magnetic field to move and orient the fibers in the ultimate direction of stress.

3. The method of claim 2, in which the fibers are distributed on the surface of the mass of unset concrete and the magnetic field moves the fibers into the mass in addition to said orientation.

4. The method of claim 1, in which the fibers are mixed into the concrete before it is cast.

5. The method of claim 2, in which the unset concrete mass is simultaneously vibrated to assist in the orientation and movement of said fibers within the mass.

6. The method of claim 2, in which the fibers are concentrated by the magnetic field in those areas of the cast mass that will be subjected to relatively greater stress.

* * * * *